US007959249B2

(12) United States Patent
Eguchi et al.

(10) Patent No.: US 7,959,249 B2
(45) Date of Patent: Jun. 14, 2011

(54) LIQUID-EJECTING HEAD, LIQUID-EJECTING DEVICE, LIQUID-EJECTING METHOD, AND EJECTION MEDIUM FOR LIQUID-EJECTING HEAD

(75) Inventors: Takeo Eguchi, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/139,907

(22) Filed: Jun. 16, 2008

(65) Prior Publication Data

US 2008/0259128 A1 Oct. 23, 2008

Related U.S. Application Data

(62) Division of application No. 11/359,192, filed on Feb. 22, 2006.

(30) Foreign Application Priority Data

Feb. 28, 2005 (JP) ..... 2005-052179

(51) Int. Cl.
*B41J 29/38* (2006.01)

(52) U.S. Cl. ..... 347/17

(58) Field of Classification Search ..... None
See application file for complete search history.

(56) References Cited

U.S. PATENT DOCUMENTS

| | | | | |
|---|---|---|---|---|
| 5,459,498 | A | 10/1995 | Seccombe et al. | |
| 2001/0000669 | A1 * | 5/2001 | Uchida et al. | 347/33 |
| 2002/0001015 | A1 * | 1/2002 | Kojima et al. | 347/47 |

FOREIGN PATENT DOCUMENTS

| | | |
|---|---|---|
| EP | 0 752 313 | 1/1997 |
| EP | 0 838 332 | 4/1998 |

OTHER PUBLICATIONS

European Search Report dated Aug. 28, 2006.

* cited by examiner

*Primary Examiner* — Matthew Luu
*Assistant Examiner* — Justin Seo
(74) *Attorney, Agent, or Firm* — SNR Denton US LLP

(57) ABSTRACT

A liquid-ejecting head includes a liquid cell that contains an ejection medium that is liquid at normal temperature, a nozzle for ejecting the ejection medium in the liquid cell, an energy unit for supplying ejection energy to the ejection medium in the liquid cell, and heating means for heating the liquid cell independently of the supply of the ejection energy to the ejection medium in the liquid cell. The energy unit is driven to eject the ejection medium from the nozzle in a droplet form. The heating means is supplied with a substantially direct current component to generate heat so that at least the temperature of the liquid cell is constantly maintained above the ambient temperature irrespective of whether the energy unit is driven.

1 Claim, 9 Drawing Sheets

FIG. 8

| | EMBODIMENT | | KNOWN ART |
|---|---|---|---|
| | HEAT-GENERATING RESISTOR (FOR EJECTION) | HEATING ELEMENT (FOR HEATING) | HEAT-GENERATING RESISTOR (FOR EJECTION AND HEATING) |
| HEAD SIZE | 1.63 × 15.4 ×0.65 (mm) | | |
| TYPE OF ELEMENT | RESISTOR | NMOS TRANSISTOR | RESISTOR |
| RESISTANCE (Ω/25°C) | 120 | - | 106 |
| NUMBER OF ELEMENTS | 320 | 42/84 | 320 |
| ELEMENT DRIVE MODE | SWITCHING | AMPLIFICATION (UP TO SATURATION) | SWITCHING |
| NUMBER OF ELEMENT DRIVES ARRANGED | 32 HIGH-VOLTAGE NMOS TRANSISTORS | 1 HIGH-VOLTAGE NMOS TRANSISTOR | 32 HIGH-VOLTAGE NMOS TRANSISTORS |
| POWER SUPPLY VOLTAGE | 10 (V) | | |
| DRIVE CURRENT | 75 mA PULSE | < 4 mA DIRECT CURRENT | 80 mA PULSE |
| ELEMENT HEAT-GENERATING CAPABILITY (W) | 0.83 | < 0.04 | 0.45/0.9 * |
| MAXIMUM HEAT-GENERATING CAPABILITY (W) | 4.2 | 1.5/3.0 | 2.25/4.5 * |
| ADJUSTABLE TEMPERATURE RANGE (°C) | FIXED | 25-70 | FIXED |

* ON THE ASSUMPTION THAT THE DURATION OF CURRENT SUPPLY FOR PREHEATING IS HALF THAT OF CURRENT SUPPLY FOR EJECTION

LIQUID-EJECTING HEAD, LIQUID-EJECTING DEVICE, LIQUID-EJECTING METHOD, AND EJECTION MEDIUM FOR LIQUID-EJECTING HEAD

RELATED APPLICATION DATA

This application is a divisional of U.S. patent application Ser. No. 11/359,192, filed Feb. 22, 2006, the entirety of which is incorporated herein by reference to the extent permitted by law. The present invention claims priority to Japanese Patent Application No. 2005-052179 filed in the Japanese Patent Office on Feb. 28, 2005, the entirety of which also is incorporated by reference herein to the extent permitted by law.

BACKGROUND OF THE INVENTION

The present invention relates to liquid-ejecting heads, liquid-ejecting devices, and liquid-ejecting methods for ejecting an ejection medium contained in liquid cells from nozzles in a droplet form by driving energy units, and also relates to ejection media for the liquid-ejecting heads. Specifically, the present invention relates to techniques for providing liquid-ejecting devices with high ejection stability and a significantly wide operating temperature range.

Inkjet printers are one of the known liquid-ejecting devices for ejecting an ejection medium, such as a liquid, contained in liquid cells from nozzles in a droplet form by driving energy units. A typical inkjet printer includes an inkjet head (a type of liquid-ejecting head) having nozzles arranged in line. The inkjet printer supplies ejection energy to ink by driving energy units to sequentially eject fine ink droplets from the nozzles to a recording medium, namely printing paper. The ink droplets land on the printing paper to form substantially circular dots arranged in two orthogonal directions, thus expressing images and characters.

Among the types of ink ejection of inkjet printers is thermal ejection, which is the ejection of ink by supplying heat energy thereto. A thermal inkjet printer includes an inkjet head having ink cells for containing an ink (ejection medium), heat-generating resistors (energy units) disposed inside the ink cells, and nozzles for ejecting the ink contained in the ink cells in a droplet form. This type of inkjet printer rapidly heats the ink by driving the heat-generating resistors to cause the film boiling of the ink on the heat-generating resistors and thereby produce bubbles which supply energy for ejecting ink droplets.

Another type of ink ejection is electrostatic ejection. An inkjet printer utilizing electrostatic ejection has energy units, each including two electrodes separated by a diaphragm and the underlying air layer. This type of inkjet printer applies a voltage across the two electrodes to deflect the diaphragm downward. The inkjet printer then turns off the voltage to release the diaphragm from the electrostatic force. As a result, the diaphragm returns to its original state with an elastic force which ejects ink droplets.

A further type of ink ejection is piezoelectric ejection. An inkjet printer utilizing piezoelectric ejection has energy units, each including a laminate of a diaphragm and a piezoelectric element having electrodes disposed on both surfaces thereof. This type of inkjet printer applies a voltage across the two electrodes so that the piezoelectric element produces a piezoelectric effect which induces a bending moment in the diaphragm. As a result, the diaphragm bends so as to eject ink droplets.

On the other hand, serial inkjet heads are known in view of the structure of inkjet heads. A serial inkjet head has hundreds of nozzles for each color. In recording, this type of inkjet head is moved perpendicularly to the direction in which printing paper is conveyed. The inkjet head, which is used alone, mechanically reciprocates (scans) substantially over the width of the printing paper to perform recording.

Line inkjet heads are also known. A line inkjet head includes many head units arranged along the width of printing paper. These head units are connected to form a single head with the length corresponding to the recording width. This type of inkjet head can achieve high recording speed because the head has a significantly larger number of nozzles than a serial inkjet head and does not involve mechanical scanning.

In particular, thermal line heads can achieve greatly higher recording speeds than thermal serial heads. Typical thermal inkjet heads repeat a temperature-increasing operation and a temperature-decreasing operation. The temperature-increasing operation is intended for instantaneously heating ink to a high temperature (about 330° C. to 350° C., which is the critical temperature for film boiling) to produce bubbles. The temperature-decreasing operation is intended for shrinking the bubbles produced by the film boiling to successfully separate ink droplets. These operations undesirably degrade the inkjet heads because the head temperature becomes excessively high after extended continuous recording.

Thermal serial heads therefore trade off recording speed for the control of temperature rise due to ink heating within a predetermined range. Thermal line heads, by contrast, allow high-speed, high-volume continuous recording because the resultant heat can be dispersed over the width of the heads, which are wider than serial heads.

General electronic devices have predetermined operating temperature ranges, temperature ranges in which the devices operate properly with performance according to their specifications; consumer electronic devices are generally guaranteed to operate properly at about 0° C. to 40° C.

Known inkjet printers, however, are generally guaranteed to operate properly in a relatively narrow temperature range, about 15° C. to 35° C. The lower limit of the operating temperature range is high because a water-based liquid ink freezes below the freezing point or, even if the ink does not freeze, exhibits high viscosity below 15° C.; water nearly doubles in viscosity or dynamic viscosity (hereinafter simply referred to as viscosity) as the temperature thereof decreases from 35° C. to 10° C. Below 15° C., the ink becomes difficult to eject in a droplet form, and thus the amount of ink ejected decreases.

On the other hand, the upper limit of the operating temperature range is low because the ink exhibits excessively low viscosity when the head temperature rises after, for example, extended continuous recording. When an ink prepared for use at 15° C. is heated to more than 35° C., the ink exhibits extremely low viscosity which increases the amount of ink ejected. This leads to a difference in print density between before and after extended recording.

This problem will be described in more detail. For a thermal inkjet head, the head temperature and the ink temperature generally exceed the ambient temperature because of self-heating during recording operation. These temperatures, however, are not necessarily as high during standby or immediately after power-up as those during the recording operation. Because the ink viscosity becomes high below a certain temperature, as described above, ejection conditions differ between the beginning and middle of recording. Accordingly, recording at lower temperatures often results in lower print densities while recording at higher temperatures often results in higher print densities.

This problem is more serious near the upper and lower limits of the recording range of printing paper. In low-temperature environments such as cold climates, particularly, the same amount of ink ejected as that at average temperature is difficult to ensure. In addition, the direction in which the ink is ejected can vary and, more seriously, the ink can cause ejection defects. In such cases, print defects such as white streaks and white spots appear in images printed on printing paper, thus degrading recording quality.

Electrostatic and piezoelectric inkjet heads, which utilize mechanical distortion, can supply ejection energy to ink irrespective of the ambient temperature, although the ambient temperature varies the viscosity of the ink. As a result, these types of inkjet heads exhibit poor ejection properties when suddenly driven from standby at low temperature. In that case, the use of an ink with high viscosity, which can move less easily, results in thin print areas or temporal ejection failure at the beginning of recording.

In addition to the problem described above, line heads have a problem associated with small head units connected in line. The production of a one-piece line head extending over the width of printing paper is not practical; a typical line head is composed of small head units arranged in line with the ends thereof connected. These head units share recording in the recording region of printing paper over the width. The sharing, however, leads to temperature variations between the individual head units, and density variations and white streaks become serious particularly for thermal line heads.

FIG. 9 is a diagram of an example of recording results obtained using a thermal line head of the known art in a low-temperature environment. As shown in FIG. 9, many white streaks appeared at the beginning of recording, and some of them are elongated in certain recording regions.

This problem results from the fact that the temperatures of more frequently used head units rise while those of less frequently used head units remain at the ambient temperature. That is, the head units of the thermal line head are usually used with different frequencies, and thus the ink temperature differs between the head units depending on the ejection frequencies thereof. Such temperature differences cause larger differences in ink viscosity and slight variations in the ejection properties and recording densities of the individual head units, leading to white streaks as shown in FIG. 9.

As described above, inkjet printers undesirably have narrow operating temperature ranges due to the increase in ink viscosity in a low-temperature environment. This problem has increasingly become serious with recent advances in the performance of inkjet printers. Recent inkjet printers have achieved higher recording densities with finer ink droplets. Accordingly, the number of ejection operations is increased to achieve higher recording densities without decreasing print density. For thermal line heads, in consequence, larger temperature differences occur between more frequently used head units and less frequently used head units, and thus white streaks appear more significantly.

On the other hand, the size reduction of nozzle holes for finer ink droplets leads to increased viscous drag of ink. In that case, the increase in ink viscosity in a low-temperature environment becomes more serious irrespective of the type of ink ejection (thermal ejection, electrostatic ejection, or piezoelectric ejection) or the structure of inkjet heads (serial heads or line heads).

It may be possible to arrange all head units for a thermal line head on a substrate with good thermal conductivity to reduce temperature differences between the individual head units. This approach, however, encounters another problem associated with thermal expansion. In general, materials with higher thermal conductivity tend to have higher thermal expansion coefficients. If a line head is constructed by bonding the base members of the head units, namely semiconductor substrates, to another substrate with a different thermal expansion coefficient, the head experiences significant thermal strain which can vary the ejection properties even within an operating temperature range of, for example, 15° C. to 35° C.

It may also be possible to perform preliminary ejection before recording to ensure predetermined ejection properties at the beginning of recording. The preliminary ejection, however, wastes a substantial amount of ink irrespective of recording on printing paper, thus increasing ink consumption and operating cost.

It may also be possible to supply preheat pulses (drive pulses with such a small width as to produce no bubbles) to heat-generating resistors of a thermal inkjet head to preheat the heat-generating resistors and thereby heat the ink to an appropriate temperature range before recording. This method, however, takes much time before recording (first print).

The technique of manually switching an inkjet printer between a high-quality recording mode and an immediate recording mode is known. If the temperature of an inkjet head is measured to be lower than a reference temperature in the high-quality recording mode, the inkjet head is preheated to the reference temperature or higher before recording. In the immediate recording mode, on the other hand, the inkjet head immediately starts recording.

According to Japanese Unexamined Patent Application Publication No. 2000-108328, for example, optimum recording can be performed for different applications by selecting a high-quality recording mode with sufficient preheating or a short-time rapid recording mode with some degradation in recording quality.

The technique according to the publication, however, has difficulty in simultaneously achieving improved recording quality and high-speed recording to constantly ensure high ejection stability. In addition, this technique undesirably complicates the overall system because special consideration is given to preheat the inkjet head only when the measured head temperature falls below the reference temperature. Furthermore, this publication makes no disclosure of the extension of the operating temperature ranges of inkjet printers.

SUMMARY OF THE INVENTION

Accordingly, it is desirable to provide a liquid-ejecting head, a liquid-ejecting device, a liquid-ejecting method, and an ejection medium for the liquid-ejecting head which constantly ensure high ejection stability by reducing the effects of changes in head temperature due to use environments on ink properties, particularly variations in the amount of ink droplets ejected and the direction in which the ink droplets are ejected, to simultaneously achieve improved recording quality and high-speed recording and provide a wider operating temperature range.

A liquid-ejecting head according to an embodiment of the present invention includes a liquid cell that contains an ejection medium that is liquid at normal temperature, a nozzle for ejecting the ejection medium in the liquid cell, an energy unit for supplying ejection energy to the ejection medium in the liquid cell, and heating means for heating the liquid cell independently of the supply of the ejection energy to the ejection medium in the liquid cell. The energy unit is driven to eject the ejection medium from the nozzle in a droplet form. The heating means is supplied with a substantially direct current component to generate heat so that at least the temperature of the liquid cell is constantly maintained above the ambient temperature irrespective of whether the energy unit is driven.

A liquid-ejecting device for recording by allowing droplets to land on a recording medium according to another embodiment of the present invention includes a liquid-ejecting head including a liquid cell that contains an ejection medium that is liquid at normal temperature, a nozzle for ejecting the ejection medium in the liquid cell, an energy unit for supplying ejection energy to the ejection medium in the liquid cell, and heating means for heating the liquid cell independently of the supply of the ejection energy to the ejection medium in the liquid cell. The energy unit is driven to eject the ejection medium from the nozzle in a droplet form. The heating means is supplied with a substantially direct current component to generate heat so that at least the temperature of the liquid cell is constantly maintained above the ambient temperature irrespective of whether the energy unit is driven.

A liquid-ejecting method according to another embodiment of the present invention includes the steps of supplying a substantially direct current component to heating means for heating a liquid cell that contains an ejection medium that is liquid at normal temperature to generate heat so that at least the temperature of the liquid cell is constantly maintained above the ambient temperature; and driving an energy unit to supply ejection energy to the ejection medium in the liquid cell so that the ejection medium is ejected from a nozzle in a droplet form. The step of supplying the substantially direct current component is performed independently of the step of driving the energy unit.

According to these embodiments, when a liquid ejection medium is used at normal temperatures above the freezing point, the heating means, which is unrelated to the ejection operation, generates heat to maintain the liquid cell at an appropriate temperature higher than the ambient temperature during standby for ejection. The heating means can therefore maintain the ejection medium, which is contained in the liquid cell, at a constant temperature higher than the ambient temperature irrespective of the ambient temperature during standby and ejection operation.

According to another embodiment of the present invention, there is provided an ejection medium for a liquid-ejecting head that has a liquid cell for containing the ejection medium and an energy unit for supplying ejection energy to the ejection medium so that the ejection medium is ejected from a nozzle in a droplet form. The ejection medium is liquid at normal temperature and has viscosity suitable for ejection at a temperature at which the liquid cell is constantly maintained by heating means. The maintained temperature is higher than the ambient temperature of the liquid-ejecting head.

The ejection medium according to this embodiment exhibits ideal properties for use in the liquid-ejecting head, the liquid-ejecting device, and the liquid-ejecting method according to the embodiments described above. The ejection medium is not necessarily water, and may be, for example, an organic solvent or water containing an organic solvent. The ejection medium can be optimized for use in the liquid-ejecting head, the liquid-ejecting device, and the liquid-ejecting method according to the above embodiments by suitably adjusting the viscosity of the ejection medium, which is most closely related to temperature among various liquid properties.

According to these embodiments, an ejection medium is maintained at a constant temperature higher than the ambient temperature to have viscosity suitable for ejection. An ejection medium that is liquid at normal temperature in these embodiments is different from, for example, a solid ink that is liquefied before ejection. That is, the concept of these embodiments is different from the ejection of a solid ejection medium through liquefaction in that a liquid ejection medium with suitable viscosity is used. The normal temperature in these embodiments refers to a range of 5° C. to 35° C. under the standard atmospheric conditions for testing according to JIS (Japanese Industrial Standards) Z 8703.

The liquid-ejecting head, the liquid-ejecting device, and the liquid-ejecting method according to the above embodiments of the present invention maintain a liquid ejection medium contained in a liquid cell at a constant temperature during standby and ejection so that the ejection medium has viscosity suitable for ejection. The liquid-ejecting head, the liquid-ejecting device, and the liquid-ejecting method can therefore maintain stable ejection properties to prevent start-up ejection failure immediately after power-up or in intermittent ejection, enables high-speed continuous recording with a wider operating temperature range, and can efficiently eject fine droplets or an ejection medium with high viscosity at normal temperature.

The ejection medium according to the embodiment of the present invention has viscosity suitable for ejection at the temperature of the liquid cell of a liquid-ejecting head. The ejection medium therefore exhibits preferred properties for use in the liquid-ejecting head, the liquid-ejecting device, and the liquid-ejecting method according to the above embodiments of the present invention, thus largely improving recording quality.

BRIEF DESCRIPTION OF THE DRAWINGS

FIG. 8 is a table showing a comparison of heat-generating resistors and heating elements used in the inkjet head unit according to this embodiment with heat-generating resistors used in an inkjet head unit of the known art.

DETAILED DESCRIPTION OF THE PRESENTLY PREFERRED EMBODIMENTS

Figure 1:
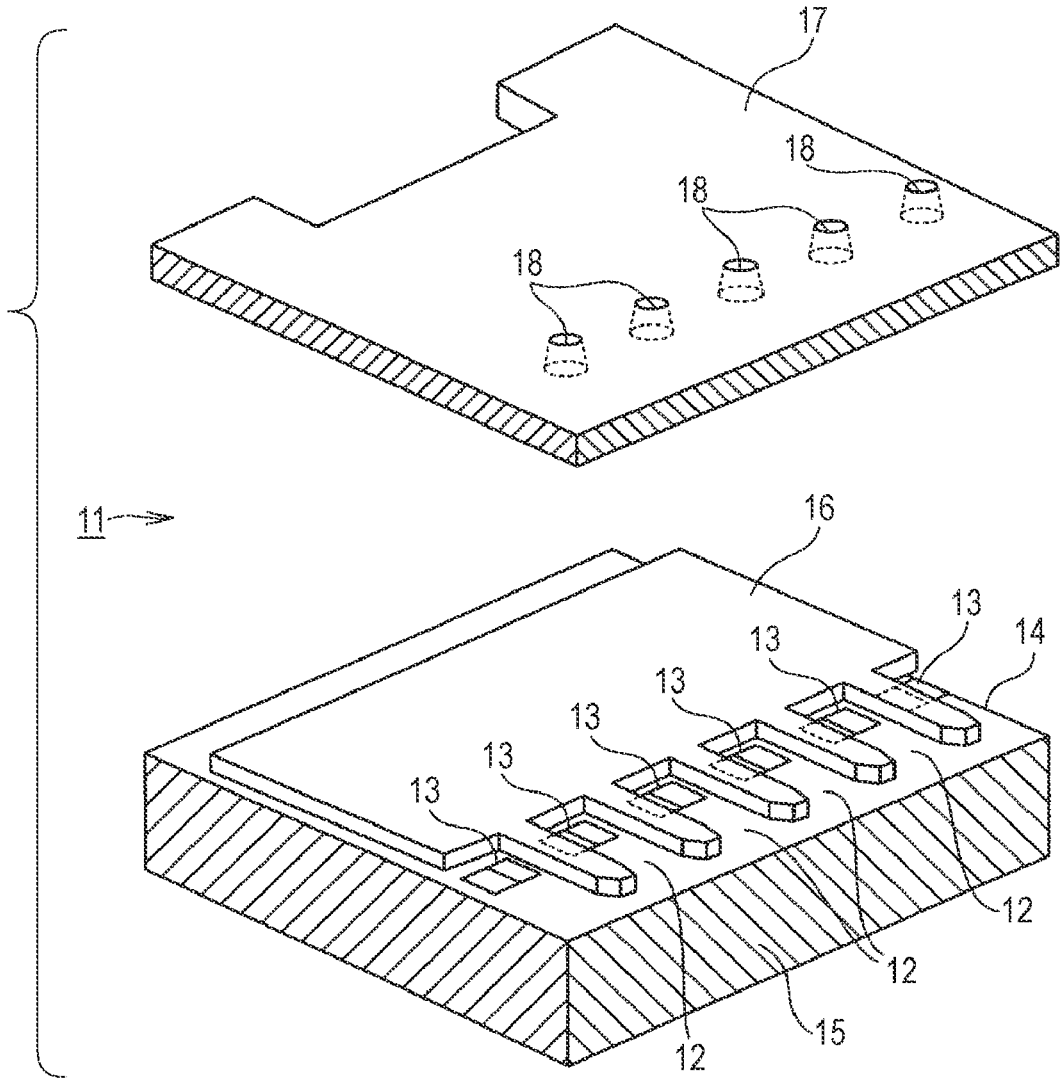
FIG. 1 is a partial perspective view of an inkjet head unit according to an embodiment of the present invention.

An embodiment of the present invention will now be described with reference to the drawings. In this embodiment, a liquid-ejecting head corresponds to inkjet head units 11 for an inkjet printer, as shown in FIG. 1. In addition, an ejection medium that is ejected by the inkjet head units 11 and is liquid at normal temperature is an ink in this embodiment. Furthermore, liquid cells for containing the ink are ink cells 12, and a trace amount (for example, several picoliters) of ink ejected from nozzles 18 in a droplet form is an ink droplet.

In this embodiment, the inkjet head units 11 are thermal inkjet head units including heat-generating resistors 13 serving as energy unit energy units. The heat-generating resistors 13 are formed by deposition on a surface of a semiconductor substrate 15 serving as a base member 14. The thermal inkjet head units 11 are arranged along the width of printing paper, as a recording medium, to constitute a thermal line head 10. In this embodiment, a liquid-ejecting device corresponds to an inkjet printer having the thermal line head 10.

FIG. 1 is a partial perspective view of each of the inkjet head units 11 according to this embodiment. In FIG. 1, the inkjet head 11 includes the semiconductor substrate 15 serving as the base member 14, a barrier layer 16 stacked on the semiconductor substrate 15, and a nozzle sheet 17 stacked on the barrier layer 16. In FIG. 1, the nozzle sheet 17 is separately illustrated for convenience of description.

The semiconductor substrate 15 is formed of, for example, silicon, glass, or ceramic. The heat-generating resistors 13 are formed on the surface of the semiconductor substrate 15 (the top surface in FIG. 1) by deposition using microfabrication techniques for manufacturing semiconductor electronic devices (for example, sputtering with the material for the heat-generating resistors 13). The heat-generating resistors 13 are electrically connected to external circuitry through, for example, conductors (not shown) formed on the semiconductor substrate 15 by similar techniques and a drive circuit and a control logic circuit disposed inside the semiconductor substrate 15.

The barrier layer 16 is disposed on the same side of the semiconductor substrate 15 as the heat-generating resistors 13. The barrier layer 16 is formed in the area other than the peripheries of the heat-generating resistors 13 by patterning a photosensitive resin. Specifically, the barrier layer 16 is formed by applying, for example, a photosensitive cyclized rubber resist or a photocurable dry film resist over the surface of the semiconductor substrate 15 on which the heat-generating resistors 13 are formed and then removing unnecessary portions by photolithography.

The nozzle sheet 17 is formed by, for example, electroforming with nickel (Ni) so that the circular nozzles 18 are formed in the nozzle sheet 17. The nozzle sheet 17 is accurately aligned with the semiconductor substrate 15 such that the nozzles 18 face the heat-generating resistors 13 on the semiconductor substrate 15 before the nozzle sheet 17 is stacked on the barrier layer 16.

The semiconductor substrate 15, the barrier layer 16, and the nozzle sheet 17 define the ink cells 12 so as to surround the heat-generating resistors 13: the semiconductor substrate 15 and the heat-generating resistors 13 form the top surfaces of the ink cells 12, the barrier layer 16 forms three sidewalls of each ink cell 12, and the nozzle sheet 17 forms the bottom surfaces of the ink cells 12. In FIG. 1, the inkjet head unit 11 is illustrated upside down to clearly show the relative positions of the heat-generating resistors 13 and the nozzles 18.

The ink cells 12 have open areas on the lower right thereof in FIG. 1. These open areas communicate with a common ink channel to supply an ink stored in an ink tank (not shown) to the individual ink cells 12 through the common ink channel.

The inkjet head unit 11 normally has 100 sets of the ink cells 12, the heat-generating resistors 13, and the nozzles 18. The heat-generating resistors 13 are selectively driven according to instructions from a control part of an inkjet printer to supply ejection energy to the ink contained in the ink cells 12 and thereby eject ink droplets from the nozzles 18. In this embodiment, many inkjet head units 11 are arranged along the width of printing paper, as a recording medium, to constitute the line head 10.

Figure 2A:
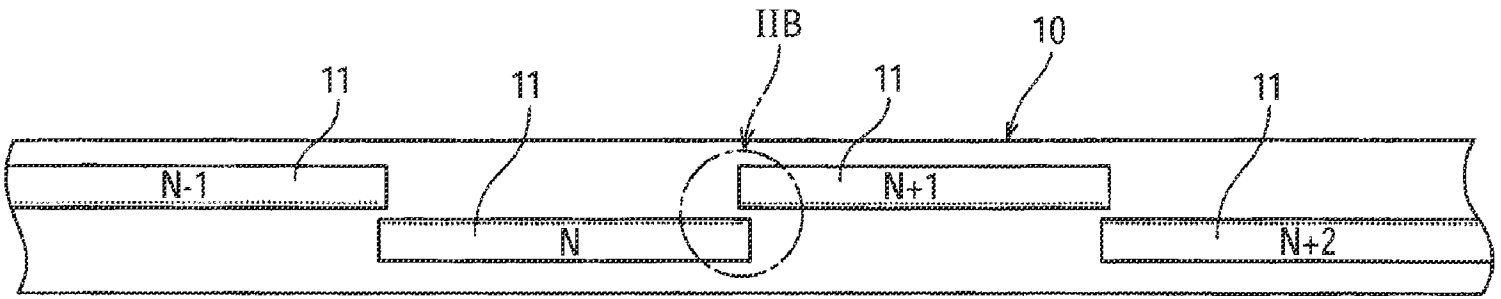
FIG. 2A is a plan view of a line head according to this embodiment.
Figure 2B:
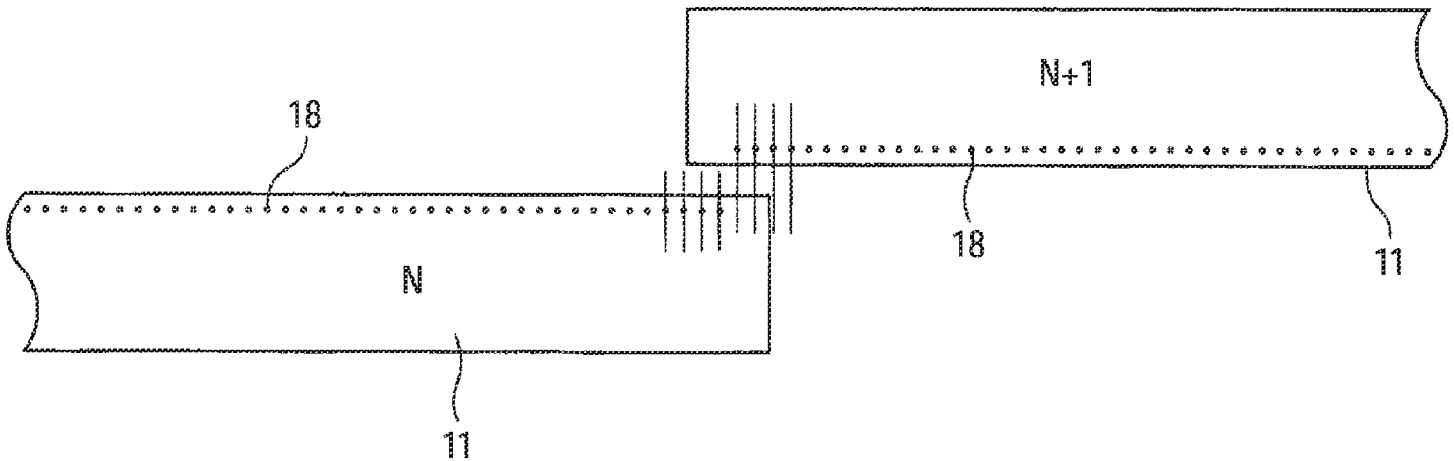
FIG. 2B is an enlarged view of a part indicated by arrow IIB in FIG. 2A.

FIG. 2A is a plan view of the line head 10 according to this embodiment, illustrating four inkjet head units 11 (the (N−1) th, Nth, (N+1)th, and (N+2)th inkjet head units 11) arranged in series. FIG. 2B is an enlarged view of a part indicated by arrow IIB in FIG. 2A. The line head 10 is constituted by arranging the inkjet head units 11 in series without the nozzle sheet 17 and then stacking the single nozzle sheet 17 thereon.

The individual nozzles 18 of the line head 10, including those at the adjacent ends of the inkjet head units 11, are disposed at a regular pitch. As shown in FIG. 2B, for example, the Nth and (N+1)th inkjet head units 11 are arranged such that the rightmost nozzle 18 of the Nth inkjet head unit 11 and the leftmost nozzle 18 of the (N+1)th inkjet head unit 11 are disposed at the same pitch as the other nozzles 18 of the inkjet head units 11.

In addition, color printing is enabled by arranging a necessary number of line heads 10 perpendicularly to the direction in which the nozzles 18 are arrayed to supply inks of different colors to the line heads 10. For example, four line heads 10 corresponding to yellow (Y), magenta (M), cyan (C), and black (K) colors may be arranged to produce a color inkjet printer.

The inks of the four colors, which are stored in four ink tanks (not shown) connected to the line heads 10, are supplied to the individual line heads 10 and are contained in the ink cells 12 shown in FIG. 1. The heat-generating resistors 13 are then supplied with a pulsed current for a short time (for example, 1 to 3 μsec) according to print data to rapidly generate heat. The resultant heat causes film boiling at part of the ink in contact with the heat-generating resistors 13 to produce bubbles in the ink. The bubbles then expand and displace a predetermined volume of ink to eject ink droplets with substantially the same volume as the displacement. The ejected droplets land on printing paper, thus performing color recording.

Although the line heads 10 according to this embodiment can perform color recording on printing paper, as described above, temperature differences occur between the line heads 10 as a result of differences in the heating frequency of the heat-generating resistors 13 between the line heads 10; they result from differences in the amount of ink ejected between the inks of the individual colors. Such temperature differences also occur between the inkjet head units 11 of the line heads 10, between the ink cells 12 of the inkjet head units 11, and between the beginning and middle of recording. These temperature differences vary ink viscosity; high ink viscosity can cause ejection defects.

For inkjet printers to ensure predetermined recording quality, therefore, an inkjet head in operation is maintained within a predetermined operating temperature range so as not to cause ejection defects. Three approaches to setting the operating temperature to prevent ejection defects will be described below.

Figure 3:
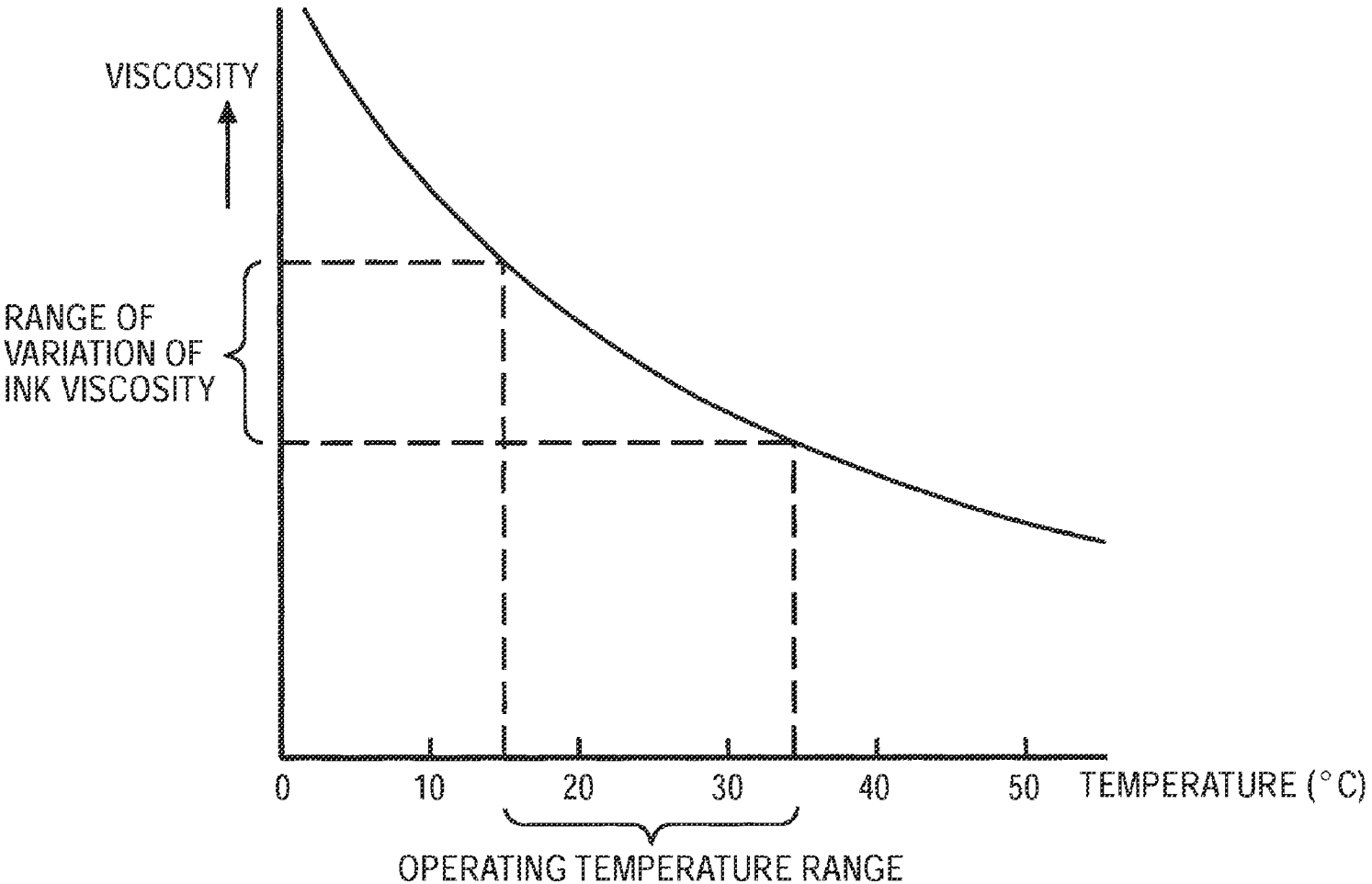
FIG. 3 is a graph showing a relationship between ink viscosity and operating temperature range according to a first approach to setting operating temperature (based on the known art)
Figure 4:
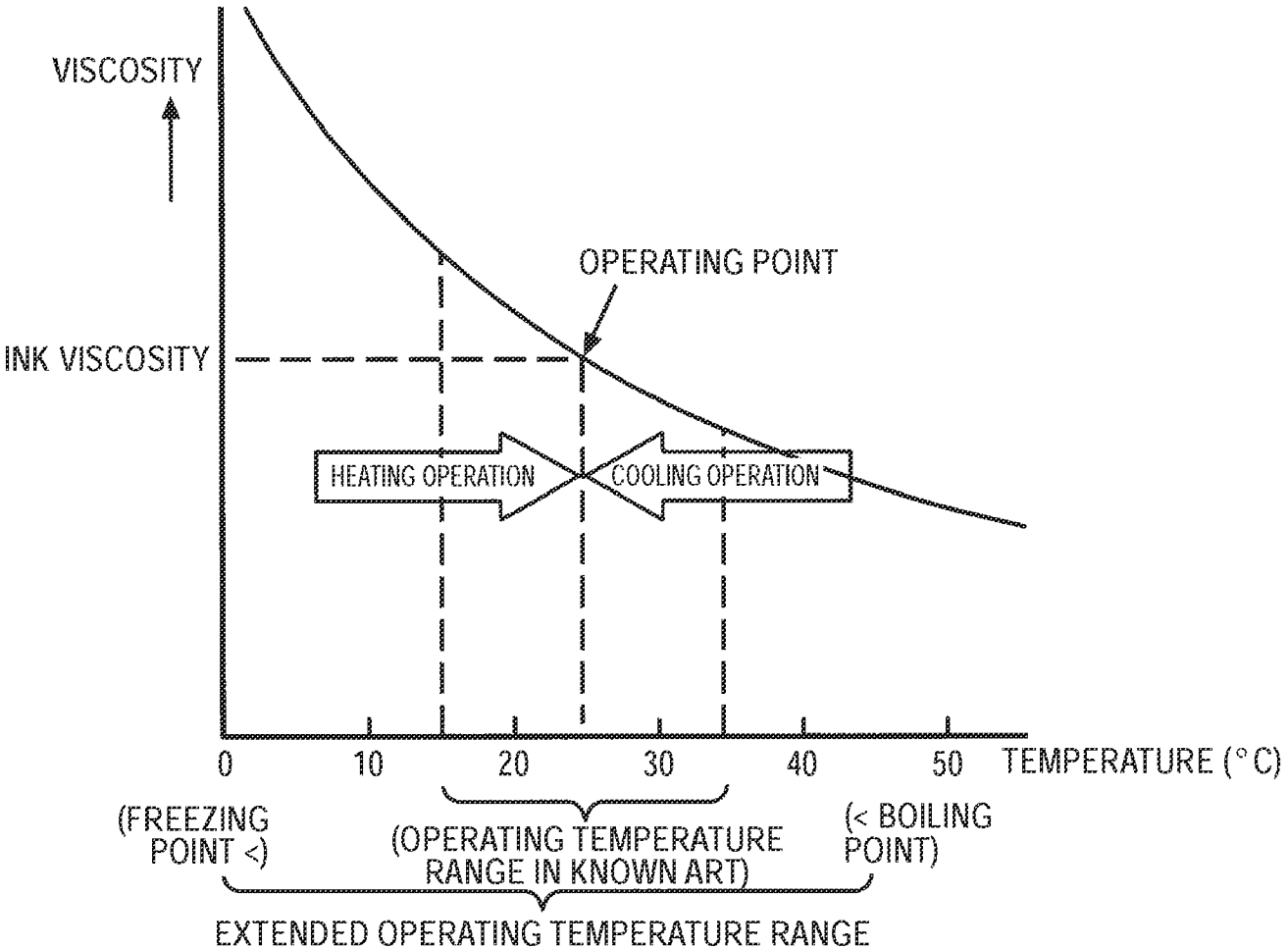
FIG. 4 is a graph showing a relationship between ink viscosity and operating temperature range according to a second approach to setting the operating temperature (based on a modification of the known art)
Figure 5:
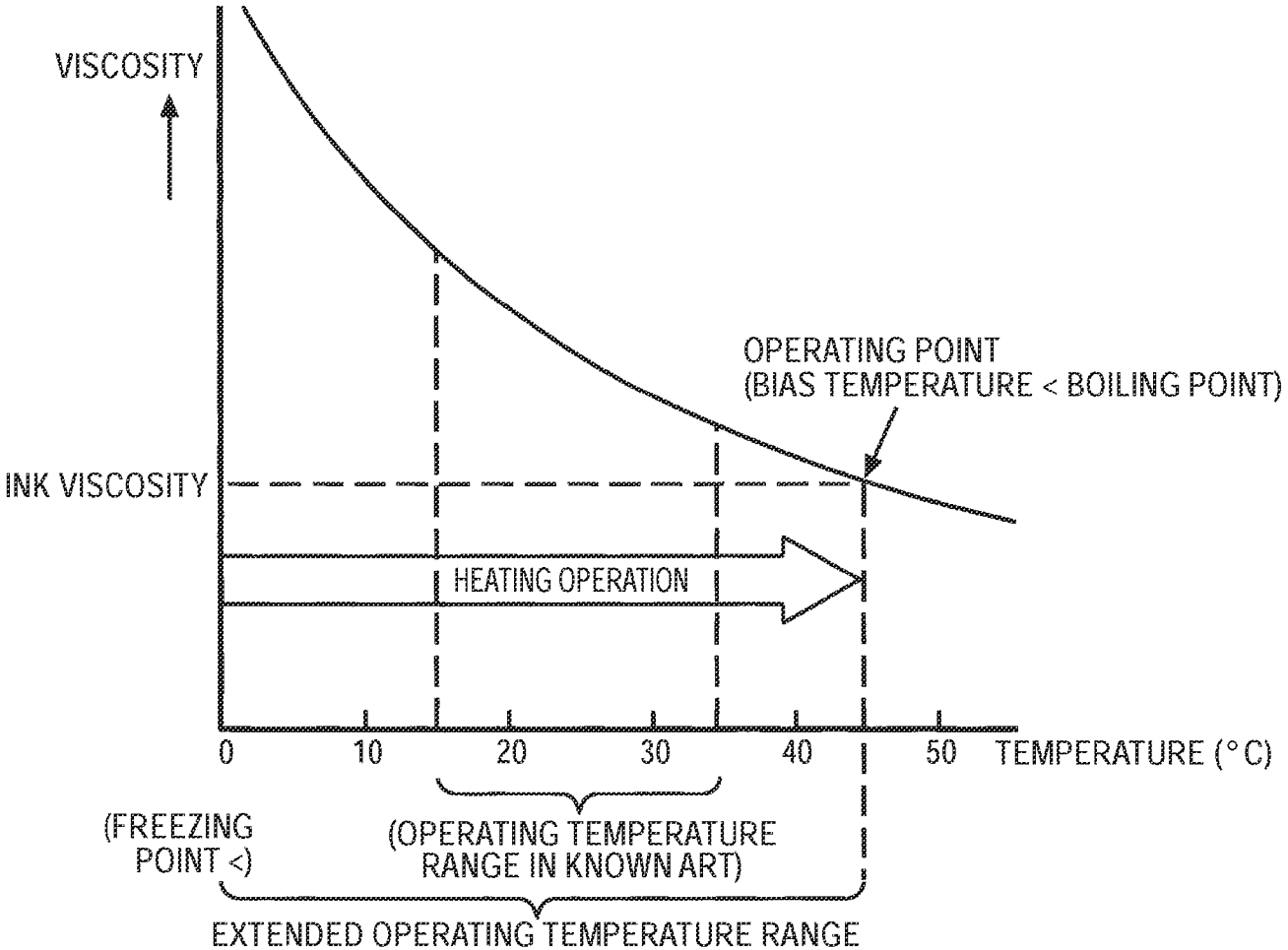
FIG. 5 is a graph showing a relationship between ink viscosity and operating temperature range according to a third approach to setting the operating temperature (based on the embodiment of the present invention)

FIGS. 3, 4, and 5 are graphs showing relationships between ink viscosity and operating temperature range according to first, second, and third approaches, respectively, for setting the operating temperature. The first approach shown in FIG. 3 is based on the known art. The second approach shown in FIG. 4 is a possible modification of the first approach. The third approach shown in FIG. 5 is based on the embodiment of the present invention.

Referring to FIG. 3, the viscosity of a water-based ink at 10° C. is nearly twice that of the ink at 35° C. According to the first approach of the known art, a known non-preheating inkjet printer is optimized for operation at the ink viscosity corresponding to substantially the center of an expected operating temperature range, and an acceptable range of deviation is evenly distributed above and below the center of the expected operating temperature range. In FIG. 3, for example, the inkjet printer is optimized for operation at 25° C., and the acceptable range of deviation is set as ±10° C. with respect to the operating temperature. The operating temperature range of the inkjet printer is thus relatively narrow, namely 15° C. to 35° C.

The first approach, which is very common, undesirably poses difficulty in providing a predetermined effect even within the operating temperature range if any parameter that varies sharply exists. A thermal inkjet printer, for example, experiences a large temperature difference between the beginning and middle of recording; the ink temperature often varies over the entire operating temperature range, namely from 15° C. to 35° C. As a result, the ink viscosity varies extremely widely, as shown in FIG. 3, thus making it difficult to achieve stable recording quality.

According to the second approach shown in FIG. 4, a specific temperature is defined as a standard operating temperature (operating point); device operation is limited to the operating point by heating operation if the ink temperature falls below the operating point and by cooling operation if the ink temperature exceeds the operating point. In FIG. 4, for example, the operating point is set to 25° C., and the ink viscosity is kept constant by heating operation at temperatures above the freezing point and below 25° C. and by cooling operation at temperatures above 25° C. and below the boiling point. The second approach can eliminate the effect of variations in ink viscosity, a significant factor for recording quality, and can also provide an extended operating temperature range, from above the freezing point to below the boiling point.

The second approach, however, involves heating and cooling operations based on the operating point to absorb variations in operating temperature, as shown in FIG. 4. While the heating operation is generally easy to perform, limited, time-consuming methods are available for the cooling operation. In addition, the use of both the heating operation (heating system) and the cooling operation (cooling system) is economically disadvantageous.

For the inkjet printer according to the embodiment of the present invention, the operating temperature range is set based on the third approach shown in FIG. 5. Specifically, an operating point is set above the operating temperature range in the known art so that any operating condition can be managed only by heating operation. The third approach, which is intended to modify the second approach, provides an extended operating temperature range from above the freezing point to below the boiling point.

To realize the third approach, the inkjet printer (inkjet head) according to this embodiment includes heating elements (equivalent to heating means) in addition to the heat-generating resistors 13 shown in FIG. 1. These heating elements generate heat when supplied with a substantially direct current component so that the inkjet printer can operate constantly above the operating temperature range in the known art. Specifically, any temperature higher than the ambient temperature is defined as an operating point (hereinafter referred to as a bias temperature). During standby for ejection, the ink cells 12 (see FIG. 1) are maintained at the bias temperature only by the heat generation with the additional heating elements, which are unrelated to the ejection operation. The ink can therefore be constantly ejected at the operating point with constant viscosity.

In addition, the use of an ink that exhibits the viscosity optimum for ejection at the bias temperature can provide an extended operating temperature range from above the freezing point to the bias temperature (below the boiling point). As shown in FIG. 5, therefore, the operating temperature range of the inkjet printer (inkjet head) according to this embodiment (extended operating temperature range) can be wider than that in the known art.

The heating elements can at least maintain the ink cells 12 at the bias temperature because the heating elements are embedded in the inkjet head units 11 (see FIG. 1). If the ink cells 12 are maintained at the bias temperature, the ink contained in the ink cells 12, which remains in contact with the ink cells 12, is automatically heated and maintained at the bias temperature.

The heating elements are supplied with the substantially direct current component to generate heat (hereinafter referred to as bias heating) until the ink cells 12 reach the bias temperature. For the known inkjet printer according to Japanese Unexamined Patent Application Publication No. 2000-108328, as described above, the preheating is performed by supplying a pulsed current to the heat-generating resistors, which are originally intended for ejection. For the inkjet printer (inkjet head) according to this embodiment, on the other hand, the bias heating is performed with a continuous current (direct current). Note that the substantially direct current component refers to a direct current component that may have fluctuations.

Such heat generation with direct current is realized by the additional heating elements unrelated to the ejection operation. The heating elements enable continuous heat generation without direct contact with the ink to avoid problems such as fractures and deterioration due to cavitation. In addition, the amount of heat generated by the heating elements can be adjusted irrespective of the power supply voltage because they are based on analog heat-generating circuits. A linear temperature control system can thus be constructed without losing the flexibility of heat generation even if the heating elements, as well as the heat-generating resistors 13 for ejection, are supplied with a fixed voltage.

In the inkjet printer (inkjet head) according to this embodiment, therefore, the heating elements are embedded in the inkjet head units 11 to maintain the ink cells 12, and hence the ink, at the bias temperature. The heating elements used are not limited to resistors; any unit that generates heat when supplied with current may be used. If, for example, transistors for control applications are used as distributed heating elements, the total amount of heat generated can be utilized effectively to achieve excellent heat generation efficiency.

The bias heating of the inkjet printer according to this embodiment, as described above, differs from the preheating of inkjet printers of the known art. Differences between bias heating and preheating are summarized below.

(1) The bias heating of the inkjet printer according to this embodiment is performed with additional heating elements rather than with elements for supplying ejection energy.

An inkjet printer of the known art performs preheating with heat-generating resistors for supplying ejection energy by making use of the idle time thereof. The preheating using the heat-generating resistors, however, is subject to many constraints. For example, the bottom portions of the heat-generating resistors (on the base member side) are formed of silicon nitride (SiN), which has lower thermal conductivity than silicon oxide ($SiO_2$), a normally used material. In heat generation, SiN inhibits the dissipation of heat to the regions other than the ink to direct the largest possible ejection energy toward film boiling at part of the ink in contact with the surfaces of the heat-generating resistors. The heat-generating resistors can thus perform satisfactory film boiling, but with low efficiency in raising the temperature of ink cells.

The heat-generating resistors, which have the intrinsic capability of instantaneously heating the ink cells to a critical temperature, are used to heat the ink cells to a fraction of the critical temperature to an order of magnitude smaller than the critical temperature. For the heat-generating resistors, which are supplied with current from the same power supply, the only way to differentiate between simple heating and heating for ink ejection may be to change the duration of the current supply with consideration given to practical circuit design constraints. In other words, there may be no choice but to control the heat-generating resistors by modulating pulse width, and no method for changing voltage may be available. To perform accurate preheating, therefore, the heat-generating resistors are controlled with high frequency, at least twice the clock frequency used for ejection. Such a control method is difficult to apply to a line head including many independent inkjet head units in view of system design; even if possible, the line head lacks usability.

For the bias heating in the embodiment of the present invention, by contrast, the heating elements can heat the ink cells 12 irrespective of the supply of ejection energy to the ink because the heating elements are independent of the heat-generating resistors 13. The heating elements therefore have high structural flexibility; for example, silicon oxide can be used on the base member 14 side. In addition, the heating elements can maintain the overall ink cells 12 and the ink in contact therewith at the bias temperature with significant efficiency. Furthermore, the heating elements can perform high-speed bias heating while reliably avoiding unsatisfactory ink ejection.

(2) The bias heating of the inkjet printer according to this embodiment is performed with a substantially direct current component.

While the preheating of an inkjet printer of the known art is performed only with a pulsed current, the bias heating in this embodiment is performed with a substantially direct current component. The use of the substantially direct current component allows the construction of a linear temperature control system which enables high-speed bias heating of the ink cells 12 with significant efficiency.

(3) In the bias heating of the inkjet printer according to this embodiment, the ink cells 12 are heated to the bias temperature, which is higher than the operating temperature range in the known art.

For the preheating of an inkjet printer of the known art, substantially the center of the operating temperature range is defined as the operating point; heat operation is performed below the operating point while no preheating is performed above the operating point. When heat-generating resistors are driven to generate heat for ink ejection, a substantial portion of the heat dissipates into the surrounding regions, and accordingly the ink is constantly heated by the excess heat to rise in temperature during the ejection operation.

The temperature of ink cells is controlled so as not to exceed the upper limit of the operating temperature range over an extended period of time, thereby preventing an unexpected increase in the amount of ink ejected due to excessively decreased ink viscosity. For example, the temperature of the ink cells is limited within the operating temperature range by reducing recording speed; a larger number of ejection operations per unit time results in a larger amount of heat generated. The recording speed is generally reduced according to information received from temperature-sensing means such as a heat-sensing element so that the temperature of the ink cells does not exceed a predetermined level.

For the bias heating in this embodiment, on the other hand, the ink cells 12 are heated to the bias temperature, which is higher than the operating temperature range in the known art. The bias heating continues if temperature-sensing means senses a temperature lower than the bias temperature, even if the ambient temperature has already reached the upper limit of the operating temperature range in the known art. The inkjet printer according to this embodiment thus only needs heat operation under any operating condition.

(4) The bias heating of the inkjet printer according to this embodiment continues until the ink cells 12 reach the bias temperature.

In general, thermal inkjet heads must support wider operating temperature ranges than piezoelectric inkjet heads because of the increase in ink temperature due to heat generated by heat-generating resistors, in addition to changes in ink temperature due to the ambient temperature. The preheating in the known art, as described above, is performed below the operating point, and is terminated when excess heat generated during ejection raises the ink temperature to the operating point and thus decreases the ink viscosity to a practically satisfactory level.

The preheating in the known art, however, is unsatisfactory at low ambient temperature because the ink temperature does not rise to the operating point for inkjet heads having less frequently used heat-generating resistors. This problem is more serious for line heads, which include many connected inkjet head units.

For the bias heating in this embodiment, on the other hand, the ink cells 12 are rapidly heated by the dedicated heating means unrelated to ejection. The bias heating is continued until the ink contained in the ink cells 12 reaches the bias temperature, and is terminated when the ink temperature exceeds the bias temperature. The bias heating thus constantly maintains the ink cells 12 at the bias temperature irrespective of whether the heat-generating resistors 13 are driven. The bias heating can therefore constantly ensure the optimum operation even for the line head 10 shown in FIG. 2A, which includes the inkjet head units 11.

It may be thought that the bias heating with the additional heating means decreases energy efficiency, although the bias heating in this embodiment requires no extra energy as compared to the preheating in the known art.

This point will be described below in detail. For the preheating in the known art, as described above, substantially the center of the operating temperature range is defined as the operating point. The preheating is performed to heat the ink for operation at relatively low temperatures below the operating point. After the preheating is terminated, the ejection operation is continued with heat for ejection. If continuous ejection excessively increases the ink temperature, the recording speed is reduced so as to limit the ink temperature within the operating temperature range.

For the bias heating in this embodiment, on the other hand, the heating elements heat the ink to the bias temperature, which is higher than the operating temperature range in the known art, and maintains the bias temperature by supplying slight power (energy) as needed. In ejection, the heat-generating resistors 13 are supplied with power (energy) sufficient to raise the ink temperature from the bias temperature to the critical temperature for ejection (for film boiling, namely about 330° C. to 350° C.)

That is, the heating elements heat the ink cells 12 independently of the supply of the ejection energy to the ink contained in the ink cells 12 to constantly maintain the ink cells 12 at the bias temperature irrespective of whether the heat-generating resistors 13 are driven. The heat-generating resistors 13, on the other hand, are driven under the conditions optimized for ejection.

The energy for ejection is determined by the following equation:

$$\text{Energy for ejection}=K\cdot(T\max-Tr)$$

wherein Tmax is the surface temperature of the heat-generating resistors 13 at which film boiling for ejection occurs (namely, the critical temperature); Tr is the ink temperature during ejection; and K is a constant.

This equation can be transformed as follows:

$$K\cdot(T\max-Tr)=K\cdot(T\max-Tb+Tb-Tr)=K\cdot(T\max-Tb)+K\cdot(Tb-Tr) \quad (1)$$

wherein Tb is the bias temperature.

The first term of Equation (1) represents the energy for ejection, and the second term represents the energy for heating the ink cells 12 from the ambient temperature to the bias temperature. Hence, on the whole, the energy used for the bias heating in this embodiment is equal to the energy used for the preheating in the known art.

While the preheating in the known art provides the energy represented by the second term of Equation (1) by supplying extra energy for each ejection operation, the bias heating supplies the energy with the additional heating means independently of the ejection operation.

Figure 6:
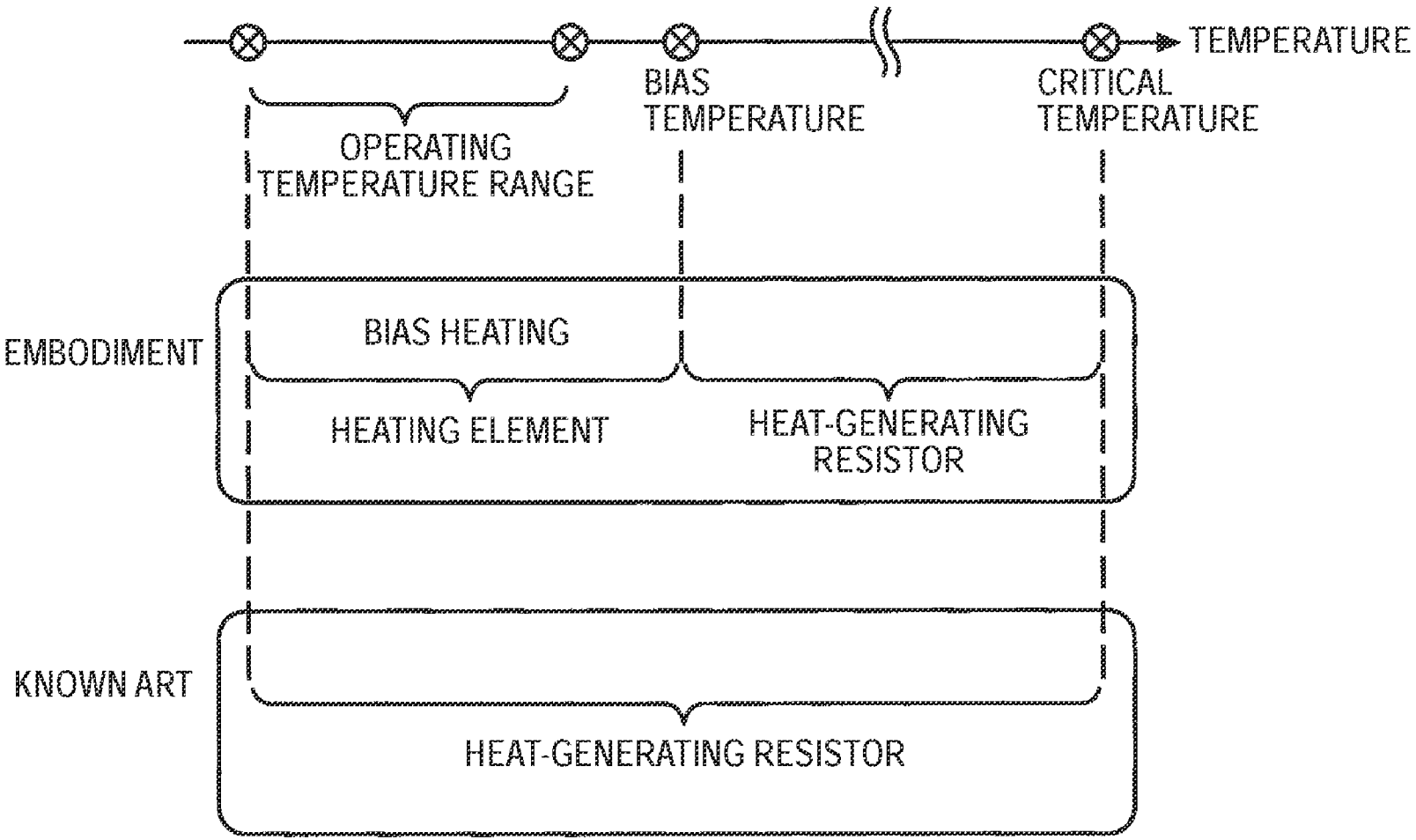
FIG. 6 is a conceptual diagram for comparing the bias heating of an inkjet printer according to this embodiment with the preheating of an inkjet printer of the known art.

FIG. 6 is a conceptual diagram for comparing the bias heating of the inkjet printer according to this embodiment with the preheating of an inkjet printer of the known art. For the preheating in the known art, as shown in FIG. 6, heat-generating resistors for ejection are used for heating in the range from the lower limit of the operating temperature range to the critical temperature. For the bias heating in this embodiment, on the other hand, the additional heating elements are used for heating in the range from the lower limit of the operating temperature range to the bias temperature (bias heating), and the heat-generating resistors 13 for ejection are used for heating in the range from the bias temperature to the critical temperature.

The ink cells 12 and the ink to be ejected are thus maintained at the bias temperature during standby by the heating elements and during ejection by controlling the amount of heat generated by the heat-generating resistors 13 with consideration given to the heating by the heating elements. The bias heating in this embodiment therefore has the same energy efficiency as the preheating in the known art.

The inkjet printer (inkjet head) according to this embodiment further includes a heat-sensing element (equivalent to temperature-sensing means) and a control circuit (equivalent to heating-control means). The heat-sensing element senses the temperature of the ink cells 12. Based on the temperature of the ink cells 12 measured by the heat-sensing element, the control circuit controls the amount of heat generated by the heating elements to accurately maintain the ink cells 12 at the bias temperature.

The inkjet printer (inkjet head) according to this embodiment thus maintains the ink cells 12 at the bias temperature with the heating elements, the heat-sensing element, and the control circuit to maintain the ink contained in the ink cells 12 at the bias temperature irrespective of the ambient temperature. The inkjet printer can therefore eject the ink with predetermined viscosity to achieve high ejection stability.

The inkjet printer (inkjet head) according to this embodiment further includes a temperature-setting unit for setting the temperature at which the ink cells 12 are maintained. Because the bias temperature depends on the type of ink used, the temperature at which the ink cells 12 are maintained may be set by any external method (the setting of a reference voltage in this embodiment) to change the operating conditions (such as heat generation and the bias temperature).

Changing the operating conditions allows the adjustment of the settings of an inkjet printer designed as common hardware for various applications for each application with easy operation, thus providing improved usability and a substantial cost reduction. Specific examples of the method used include direct change using terminals on the base member 14 (see FIG. 1) and the transmission of control signals in serial communication by time-division multiplexing.

The inkjet printer (inkjet head) according to this embodiment further includes a temperature indicator for indicating the temperature of the ink cells 12 measured by the heat-sensing element. The temperature indicator may be used to check how the inkjet printer is operating or quickly check the operating conditions thereof if there is any sign of abnormal conditions; the temperature of the ink cells 12 can be check with the temperature indicator to meet such needs.

The temperature indicator used may be, for example, any unit for externally outputting as a signal a voltage generated by the heat-sensing element when it senses the temperature of the ink cells 12. The signal may be used to externally monitor the temperature of the ink cells 12 so that a user can easily check the operating conditions of the inkjet printer for any abnormal condition. Instead of such a direct method, indirect methods may be used, including the transmission of signals indicating the temperature of the ink cells 12 by serial communication. In addition, the temperature indicator used is not limited to units for directly indicating temperature; it may also be a unit for indicating temperature increases and decreases or any abnormal temperature condition.

Figure 7:
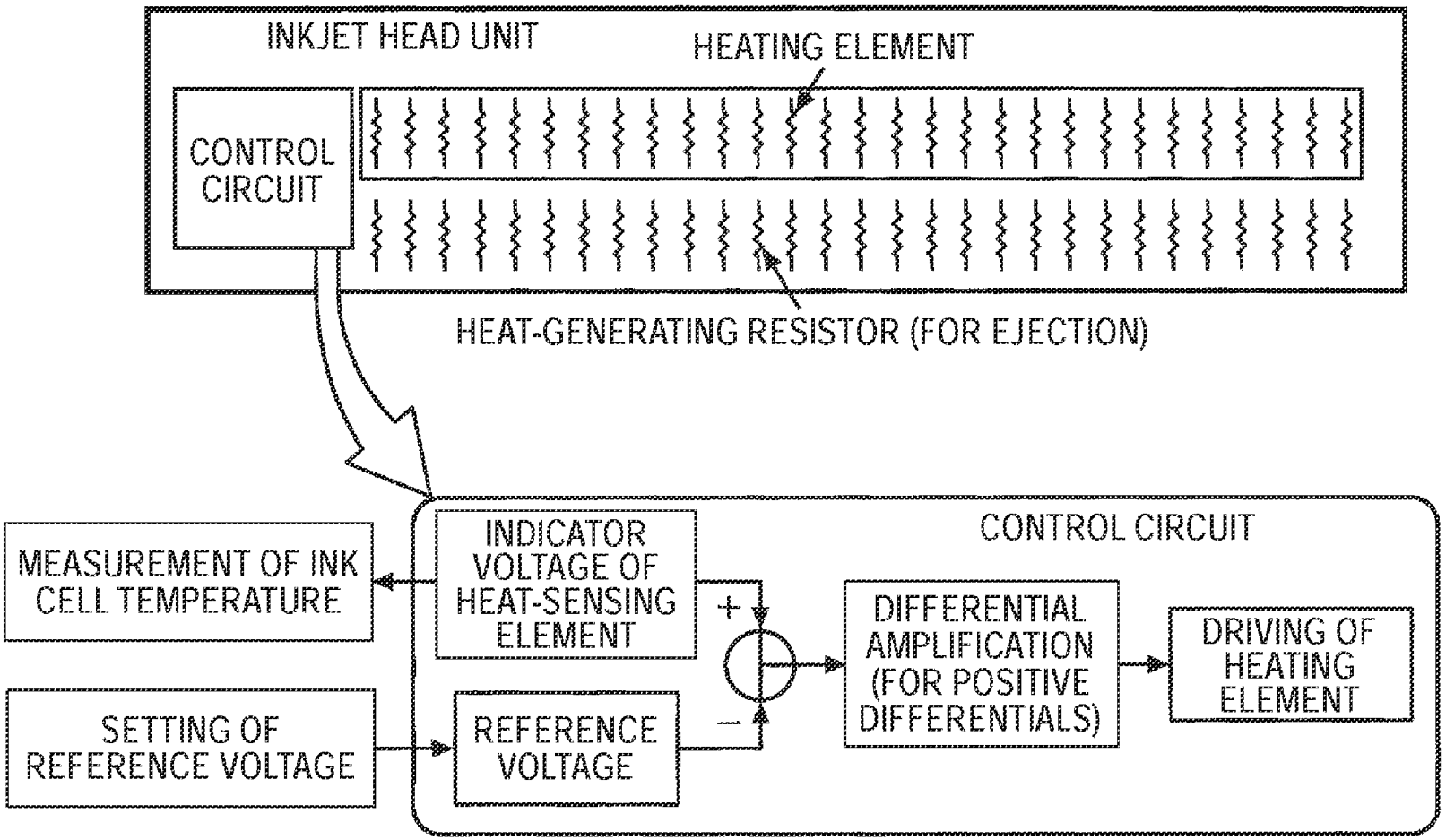
FIG. 7 is a schematic diagram of the inkjet head unit according to this embodiment.
Figure 9:
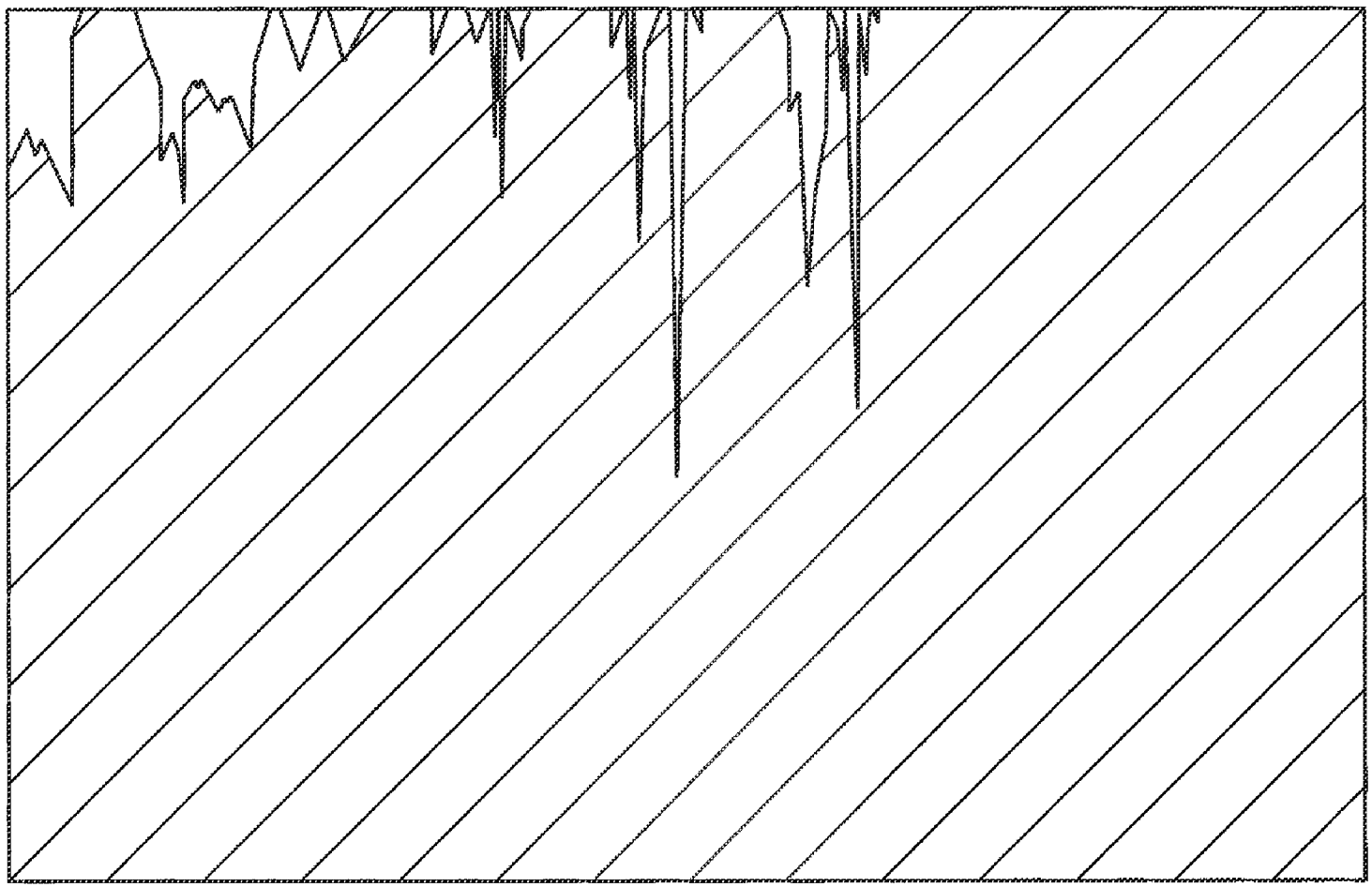
FIG. 9 is a diagram of an example of recording results obtained using a thermal line head of the know art in a low-temperature environment.

FIG. 7 is a schematic diagram of each inkjet head unit 11 according to this embodiment. In FIG. 7, the inkjet head unit 11 includes the heat-generating resistors 13 for ejection, the additional heating elements, and the control circuit for driving the heating elements based on the amount of heat generated by the heat-generating resistors 13. The control circuit has the heat-sensing element. The inkjet head unit 11 thus has an internal control system that is independent except for the setting of a reference voltage for setting the bias temperature (slight changes in direct current voltage).

The heating elements are driven based on a comparison of an indicator voltage generated when the heat-sensing element senses the temperature of the ink cells 12 with the reference voltage to minimize the effect of fluctuations in power supply voltage and thus indicate only variations due to temperature. The reference voltage may be directly supplied externally without internal reference voltage if fluctuations in power supply voltage can be eliminated by any method.

The inkjet head unit 11 according to this embodiment can thus sense the temperature of the ink cells 12 with the heat-sensing element and allows the temperature to be externally monitored by the temperature indicator described above. A positive differential between the indicator voltage from the heat-sensing element and the predetermined reference voltage is amplified to drive the heating elements, which in turn generate heat to maintain the ink cells 12 at the bias temperature.

FIG. 8 is a table showing a comparison of the heat-generating resistors 13 and heating elements used in the inkjet head unit 11 according to this embodiment with heat-generating resistors used in an inkjet head of the known art. As shown in FIG. 8, the inkjet head unit 11 according to this embodiment separately includes the heat-generating resistors 13 for ejection and the heating elements for bias heating. The inkjet head of the known art, on the other hand, includes only the heat-generating resistors, which are used for both ejection and preheating.

While the heat-generating resistors 13 are resistors, the heating elements are NMOS transistors that are driven with a direct current of less than 4 mA, rather than with a pulsed current as used for the heat-generating resistors 13. The heating elements have a maximum heat-generating capability of 3 W (or 1.5 W) so that the bias temperature of the ink cells 12 can be set within the range of 25° C. to 70° C. This level of maximum heat-generating capability is sufficient to establish the operating state of the inkjet head unit 11 more quickly than the preheating in the known art even for cold start when the bias temperature is set to 70° C., which is twice the temperature of the upper limit of the operating temperature range in the known art, namely 35° C.

Even if the inkjet printer (inkjet head) according to this embodiment maintains the ink at the bias temperature, the ink cannot necessarily be immediately and stably ejected; the performance of the inkjet printer is complemented by the ink properties. The ink used may be, for example, an organic solvent or water containing an organic solvent. Accordingly, the ink preferably has the viscosity optimum for ejection near the bias temperature, or the bias temperature is preferably controlled so that the ink has the optimum viscosity.

The ink used does not necessarily have desirable viscosity on its own. Although an ink having the viscosity optimum for ejection at the bias temperature is preferably selected, a viscosity modifier may be added so that the ink has the viscosity optimum for ejection at the bias temperature. Addition of the viscosity modifier allows easy optimization of viscosity to extend the range of choices of the ink used.

The inkjet printer according to this embodiment, as described above, maintains the ink at the bias temperature with the heating elements, rather than with the heat-generating resistors 13, irrespective of the ambient temperature. This inkjet printer can therefore eject the ink with constant viscosity to achieve high ejection stability. In addition, the use of an ink with the viscosity optimum for ejection at the bias temperature can extend the operating temperature range. Furthermore, the inkjet printer can achieve high performance, high usability, extended life, and cost reduction in manufacture or use. Advantages of the inkjet printer will be summarized below.

(1) The bias heating stabilizes ejection properties to improve performance as an inkjet printer.

The bias heating maintains the ink at substantially the same temperature to keep the viscosity thereof constant before and after the start of ejection. As a result, no startup ejection failure occurs at the beginning of ejection or if intermittent ejection continues with discontinuous recording operation. The bias heating can therefore ensure the ejection of ink droplets at a constant rate.

In addition, the inkjet head units 11 exhibit stable temperature properties because the optimum ink viscosity is constantly maintained. This inkjet printer can therefore allow the ejected ink droplets to be accurately formed and arranged in dots on printing paper, thus providing recording results with no irregularities such as density variations and streaks. The inkjet printer can also eliminate, for example, variations in the density of overall recording images due to variations in the operating temperature of the inkjet head units 11.

The ink viscosity, which is adjusted to a lower level in advance, can readily be optimized at the bias temperature, which is higher than the operating temperature range in the known art. The ink can be ejected as finer droplets because the lower ink viscosity theoretically facilitates the ejection of finer droplets with higher efficiency. This inkjet printer is particularly optimum for high-quality images such as photographs.

Furthermore, the inkjet printer can supply the ink at a higher rate to enable higher-speed operation. The ink is continuously ejected by supplying the ink in an amount equivalent to the displacement of ink for each ejection operation. The ink supply is facilitated by a smooth ink flow in the ink cells 12 and the ink channel. Such a smooth ink flow may be theoretically achieved by applying high pressure in the direction of the ink flow, increasing the cross-sectional area of the ink channel, or decreasing the ink viscosity.

Supply channels communicating with ink tanks and ink channels in inkjet head units, for example, have little effect on the flow rate even at slightly low temperatures within the operating temperature range because such channels have relatively large cross-sectional areas. However, ink channels below nozzles, for example, have extremely small heights and widths up to a dozen or so micrometers because of various constraints. Under such conditions, the ink can be supplied at high speed by maintaining the ink viscosity constantly at a low level to provide a higher total recording speed.

In particular, this system is optimum for thermal line heads. A thermal line head including larger inkjet head units experiences larger temperature differences between portions where the ejection is continuously performed and portions where almost no ejection is performed. Such temperature differences largely vary the ejection properties. For a tiling-type line head including many head units thermally separated from each other, particularly, the temperatures of the individual head units are difficult to keep uniform even if a support member with high thermal conductivity is used.

For the line head 10 according to this embodiment, on the other hand, at least temperature differences between the inkjet head units 11 during standby depend on the accuracy with which the bias temperature is maintained. The line head 10 can therefore inhibit deviations to an extremely low level to maintain the ideal conditions for tiling-type thermal line heads.

While a serial head performs recording by reciprocating movement within a predetermined range and can thus correct small flaws by overwriting, a line head does not have the overwriting function, and thus corrects such flaws by means of head units capable of deflecting ejection direction. The line head 10 according to this embodiment can enhance the effect of correction by deflecting ejection direction.

(2) The inkjet printer according to this embodiment provides high usability.

Continuous recording provides high usability when many copies of the same recording results are output or when a single document containing many pages is output. The inkjet printer according to this embodiment, as shown in FIG. 6, performs the bias heating to maintain the bias temperature during standby, and thus consumes a smaller amount of energy for ejecting ink droplets from the nozzles 18 than an inkjet printer of the known art. During the operation, the inkjet printer according to this embodiment determines whether to perform the bias heating by sensing the temperature of the ink cells 12. The inkjet printer can therefore provide a wider operating temperature range than an inkjet printer of the known art. Accordingly, the inkjet printer according to this embodiment can perform continuous recording at a higher recording speed. This advantage is particularly effective for line heads.

The inkjet printer according to this embodiment can perform the bias heating not only in the operating temperature range but also below the lower limit of the operating temperature range in the known art (for example, at 5° C. to 15° C.) if no problem occurs in the ink supply from the ink tanks and the heating elements have sufficient capability. The inkjet printer can also operate successfully above the upper limit of the operating temperature range in the known art if the ink viscosity is optimized for ejection at the bias temperature, which is higher than the operating temperature range. Accordingly, the inkjet printer advantageously has a wider operating temperature range than an inkjet printer of the known art, and can thus be used with less concern for the operating temperature range.

In addition, the inkjet printer according to this embodiment can operate immediately after power-up. The ink temperature of an idle inkjet printer of the known art is the same as the ambient temperature. If the ink temperature is low, the inkjet printer can operate stably after some waiting time. The inkjet printer according to this embodiment, by contrast, involves no waiting time because the ink is maintained at the bias temperature.

Furthermore, the inkjet printer according to this embodiment allows the ejection of an ink with high viscosity at normal temperature. An inkjet printer of the known art has difficulty in ejecting an ink that is liquid at normal temperature but has high viscosity within the operating temperature range (for example, oil-based inks and those containing a particular solvent). By contrast, the inkjet printer according to this embodiment not only can eject such inks, but also can keep them at constant temperature to minimize, for example, material degradation and property variations.

(3) The inkjet printer according to this embodiment provides extended life and cost reduction.

For thermal inkjet heads, the surfaces of heat-generating resistors are heated to a critical temperature (about 330° C. to 350° C.) to cause film boiling for ink ejection. This process causes degradation due to a burning phenomenon called kogation, which undesirably gradually decreases ejection speed. To reduce the degradation due to kogation, the components contained in the ink for ejection are preferably carefully selected. In addition, an unnecessary current supply to the heat-generating resistors is preferably minimized; however, the preheating in the known art involves short-time application of the same amount of current as for ejection to the heat-generating resistors.

The bias heating in this embodiment, by contrast, can extend the life of the heat-generating resistors 13 because the current supply to the heat-generating resistors 13 is performed only for ejection. In addition, the life of the heating elements will be semi-permanent because they are heated to, at most, a fraction of the critical temperature and do not come into direct contact with the ink.

A thermal inkjet head causes an extremely sharp pressure rise in ejection to produce high instantaneous pressure near the surfaces of ink cells and heat-generating resistors. This pressure, in combination with high ejection speed, causes cavitation which degrades the heat-generating resistors. The inkjet printer according to this embodiment, on the other hand, causes less degradation with lower pressure at the same ejection speed because the bias heating reduces the ink viscosity.

The embodiment of the present invention has been described above, although the present invention is not limited to the above embodiment. For example, the following modifications are permitted.

(1) Although the inkjet head units 11 are described as an example in this embodiment, liquid-ejecting heads are not limited to inkjet heads. For example, the present invention may be applied to various liquid-ejecting heads for ejecting other types of liquids.

(2) Although the heat-generating resistors 13 are described as an example in this embodiment, other types of heat-generating elements may be used. In addition, although the thermal inkjet head units 11 are described as an example in this embodiment, the present invention may also be applied to, for example, electrostatic inkjet heads and piezoelectric inkjet heads.

(3) Although the line inkjet head (line head) 10 is described as an example in this embodiment, the present invention is not limited to line inkjet heads, and may also be applied to serial inkjet heads (serial heads).

(4) Although the color inkjet printer is described as an example in this embodiment, the present invention may also be applied to monochrome inkjet printers, which require no mechanism for preventing the mixing of inks of different colors at the boundaries between portions corresponding to the individual inks.

Liquid-ejecting heads, liquid-ejecting devices, liquid-ejecting methods, and ejection media for the liquid-ejecting heads according to embodiments of the present invention are particularly suitable for inkjet printers, although the recording media used are not limited to printing paper. The present invention may also be applied to, for example, liquid-ejecting heads for ejecting a dye for dye goods or those for ejecting a DNA-containing solution for detecting a biological material.

It should be understood by those skilled in the art that various modifications, combinations, sub-combinations and alterations may occur depending on design requirements and other factors insofar as they are within the scope of the appended claims or the equivalents thereof.

The invention claimed is:

1. A liquid-ejecting method comprising the steps of:

supplying a continuous current to each of a plurality of heating elements operatively associated with a respective plurality of liquid cells in a liquid-ejecting head and heating each of the plurality of liquid cells therein that contains an ejection medium that is liquid at ambient temperature to generate heat so that at least the temperature of each of the liquid cells is constantly maintained at a bias temperature within the range of 25° C. to 70° C., the ejection medium having a viscosity suitable for ejection at the bias temperature, the ejection medium including a modifier so that the viscosity of the ejection medium at the bias temperature is optimized; and driving one or more heat generating energy units respectively associated with the plurality of liquid cells to supply ejection heat energy to the ejection medium in corresponding liquid cells so that the ejection medium is ejected from corresponding nozzles in a droplet form, wherein, each liquid cell is constantly maintained at the bias temperature irrespective of whether the corresponding heat energy unit is driven, and the step of supplying the continuous current is performed independently of the step of driving of the one or more energy units.

* * * * *